United States Patent [19]

Sakane et al.

[11] Patent Number: 4,709,220

[45] Date of Patent: Nov. 24, 1987

[54] RADIATION SUPPRESSION DEVICE

[75] Inventors: Toshihiko Sakane, Hyogo; Michio Ogasa, Kyoto, both of Japan

[73] Assignee: Mitsubishi Denki Kabushiki Kaisha, Tokyo, Japan

[21] Appl. No.: 903,974

[22] Filed: Sep. 4, 1986

[30] Foreign Application Priority Data

| | | | |
|---|---|---|---|
| Sep. 13, 1985 | [JP] | Japan | 60-203779 |
| Oct. 8, 1985 | [JP] | Japan | 60-153830 |
| Oct. 17, 1985 | [JP] | Japan | 60-232666 |
| Oct. 30, 1985 | [JP] | Japan | 60-168601 |

[51] Int. Cl.[4] ..... H01H 5/00

[52] U.S. Cl. ..... 335/214; 335/301

[58] Field of Search ..... 335/211, 214, 301, 304

[56] References Cited

U.S. PATENT DOCUMENTS

| | | | |
|---|---|---|---|
| 3,792,698 | 2/1974 | Pottinger et al. | 126/299 E |
| 3,824,515 | 7/1974 | Holman | 335/214 X |
| 4,237,438 | 12/1980 | McCoy | 335/214 |
| 4,337,448 | 6/1982 | Van Rooy | 335/214 |
| 4,392,083 | 7/1983 | Costello | 335/214 X |
| 4,494,692 | 1/1985 | Dobias | 236/59 |

OTHER PUBLICATIONS

S. A. Waggoner et al., "Evaluation of Steam Mufflers for the Food Processing Industry", ASAE Technical Paper No. 78-6002, 1976, pp. 1-17.

C. L. Meador et al., "Exhaust Vent Muffler Design", ASME Publication Paper No. 71-Saf-A, 1971, pp. 1-13.

Thomas Register Catalog File pp. 5753, 8193.

Universal Silencer brochure.

Vibration and Noise Engineering Corporation brochure.

Nicholson brochure.

*Primary Examiner*—George Harris

*Attorney, Agent, or Firm*—Wolf, Greenfield & Sacks

[57] ABSTRACT

Disclosed is a radiation suppression device for suppressing undesired radiation which is caused by a leak magnetic field produced by a deflecting coil that is wound around a deflection yoke of a cathode ray tube display unit. An auxiliary coil is provided which is connected electrically to the deflecting coil on the outer wall face of the deflection yoke at a position corresponding to the position at which the deflecting coil is wound and both the number of turns and the winding direction of the auxiliary coil are so selected that the leak magnetic field produced by the deflecting coil is cancelled by the magnetic field produced by the auxiliary coil which is connected in series or in parallel with the deflecting coil.

In order to allow the auxiliary coil to be mounted with ease, a plurality of hanger means are formed on the front and rear portions of the separator which forms the deflection yoke, and wires are hung over these hanger means when forming the auxiliary coil. The auxiliary coil may be held movably on the outer circumferential wall of the deflection yoke, thus enabling the auxiliary coil to be disposed at the most effective position for cancelling the undesired radiation.

14 Claims, 17 Drawing Figures

RADIATION SUPPRESSION DEVICE

BACKGROUND OF THE INVENTION

1. Field of the Invention

The present invention relates to an undesired radiation suppression device which causes the decay of a harmful and unnecessary magnetic field that is irradiated externally from a deflection yoke of a cathode ray tube in a display monitor or the like, and more particularly to a radiation suppression device that is provided with an erasing coil for extinguishing a leak magnetic field.

2. Description of the Prior Art

In general, the regulated undesired radiation frequency which is demanded by the VDE (Verband Deutscher Elektrotechniker) standard in West Germany shall be over 10 KHz and it has been an unsolved problem for a cathode ray tube display unit to deal with, inter alia, unnecessary radiation that is produced by a horizontal deflection current.

The production of the unnecessary radiation results from a leak magnetic field generated by a deflecting coil through which the horizontal deflection current flows, a flyback transformer, a horizontal separation control coil and a horizontal linearity control coil. The unnecessary radiation quantity that is irradiated outward consists of a certain proportion amounting to about 70 percent in the deflection yoke, about 20 percent in the flyback transformer and about 10 percent in other horizontal separation control coils and the like.

FIG. 1*a* is a side view of a deflection yoke 1 showing only a core 1*a* and a horizontal deflecting coil 1*b*. FIG. 1*b* is a front view of the horizontal deflecting coil 1*b* observed from the front side, that is, from the side of the funnel of a cathode ray tube 2. When the horizontal deflection current flows through the horizontal deflecting coil 1*b*, a magnetic field is produced instantaneously in the direction shown by a dotted line arrow. In this case, the horizontal deflection magnetic field 6*c* is produced in the vertical direction in the space surrounded by the core 1*a* and at the same time a separate leak magnetic field 6*a*, 6*b* is produced at the crossover coil portion 1*c*, 1*d* before and after the horizontal deflecting coil 1*b* which is to be irradiated in the external space (FIG. 1*c*).

FIG. 2 is a partly cut-away perspective view showing a prior art cathode ray tube provided with radiation suppression device. The source of undesired radiation such as the deflection yoke 1 mounted onto the cathode ray tube, the flyback transformer (not shown) and the like is surrounded by a chassis 3, a radiation plate 4 and a cover plate 5 that are composed of a metal plate with good electrical conductivity or a magnetic material, and the leak magnetic field is confined to the inner portion to reduce the level of undesired radiation irradiated outwardly to the external portion.

Since the prior art radiation suppression device has a structure in which the source of undesired radiation is surrounded by the above-described magnetic shield plate, the display monitoring apparatus is not only restricted to a considerable extent from the view point of structure, but there are also problems in that the efficiency of heat radiation of the apparatus is low and the apparatus is high in cost.

SUMMARY OF THE INVENTION

It is an object of the present invention to provide a radiation suppression device which by controlling the leak magnetic field by electrical means removes restrictions of the structural design and allows the device to be assembled at low cost.

To attain the above-described object, the present invention provides an auxiliary coil which is connected in series or in parallel with said deflecting coil on the outer wall face of said yoke corresponding to the winding position of said deflecting coil. The auxiliary coil produces a magnetic field capable of cancelling the leak magnetic field of the deflecting coil in response to a scanning frequency whereby the leak magnetic field of the deflecting coil in response to a scanning frequency whereby the leak magnetic field of the above-mentioned deflecting coil is negated. The above-described deflecting coil may, for instance, be a horizontal deflecting coil.

In a preferred embodiment, the above-described auxiliary coil is wound and formed in a saddle-shape. Accordingly, in the present invention, the undesired radiation signal stemming from the deflecting coil of a cathode ray tube can be reduced drastically and, if the scanning frequency goes high, the electrical performance of the deflecting coil is subject to no risk or harm, making it possible for the suppression device to respond easily thereto.

Further, there is no need to provide a shielding cover for physically shielding a leak magnetic filed as in the prior art, and since only the auxiliary coil is mounted on the outer wall of the deflecting coil, the structural design is advantageously freed from restrictions and the device may thus be manufactured at low cost.

It is another object of the present invention to provide a radiation suppression device in which there is no need for the deflection yoke to be surrounded by a magnetic shield plate, in which the level of undesired radiation is low and having a structure that can be simply and easily assembled.

In order to attain these objects, the present invention provides a radiation suppression device having an auxiliary coil for cancelling the leak magnetic field that is produced from the deflecting coil including a plurality of wire hanger portions that are formed with a definite form at a predetermined position on the outer face or surface of the front and rear portions of a separator which constitutes a deflection yoke, the wires being hung over and wound around the wire hanger portions.

As described above, since the device has a structure wherein a plurality of wire hanger portions are provided on the separator, the wires being wound around the wire hanger portions to form the auxiliary coil, a non-modified auxiliary coil can be simply mounted at the precise position of the deflection yoke and the level of undesired radiation from the deflection yoke can be reduced remarkably. A plurality of wire hanger portions are, preferably, composed of a groove which is formed on the outer circumferential surface of the front portion of the separator covering the front crossover line portions of the horizontal deflecting coil, depressed portions that are formed at two opposed points on the outer circumferential surface of the front portions of the separator, and hooks that are formed on the circumferential surface and the back face of the rear portion of the separator which covers the rear crossover line portions of the deflecting coil.

It is a still further object of the present invention to provide radiation suppression device which does not need to have the deflection yoke surrounded by the magnetic shielding plate, wherein the level of undesired radiation is kept remarkably low and wherein the device is flexible enough to be adapted to any casing structure.

For attaining these objects, the present invention provides holding means for holding an auxiliary coil that is movably mounted on the wall face of the outer circumference of the deflection yoke and is connected electrically to the deflecting coil. Based upon the fact that the auxiliary coil is movable, the distribution form of the magnetic field produced therefrom can be varied, thus allowing undesired magnetic field to be effectively cancelled in response to a complicated change of the magnetic field due to, for example, the reflection of the undesired magnetic field of the deflecting coil.

The present invention, is advantageous in that, since the auxiliary coil is held movably the device can be adapted even if the structure of the housing is modified without adversely affecting the function of radiation suppression and thus is always able to achieve the maximum suppression effect with respect to the undesired radiation.

BRIEF DESCRIPTION OF THE DRAWING

The foregoing and other objects, features and advantages of the invention will be apparent from the following detailed description of the preferred embodiments of the invention, taken together with the accompanying drawings in which.

Turning now to the drawings, it is to be noted that similar reference numerals denote similar component throughout the drawings.

DESCRIPTION OF THE PREFERRED EMBODIMENT

Figure 1A:
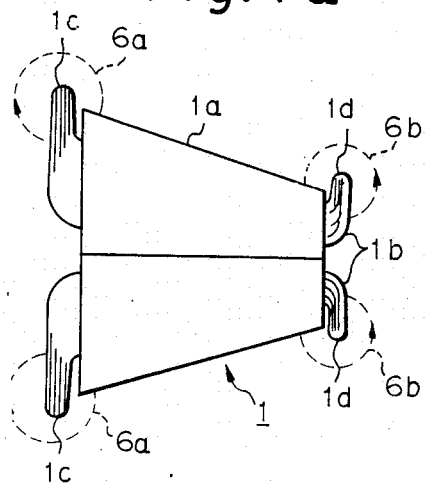
FIG. 1*a* is a side elevational view showing the configuration of the core of a deflection yoke and a horizontal deflecting coil used in a prior art cathode ray tube display unit.
Figure 1B:
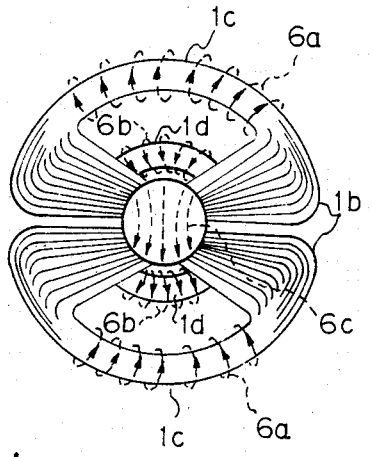
FIGS. 1*b* and 1*c* are explanatory diagrams illustrating a leak magnetic field of the horizontal deflecting coil in FIG. 1*a;*

Referring now to the drawings preferred embodiments of the present invention will hereinafter be described in detail.

Figure 3A:
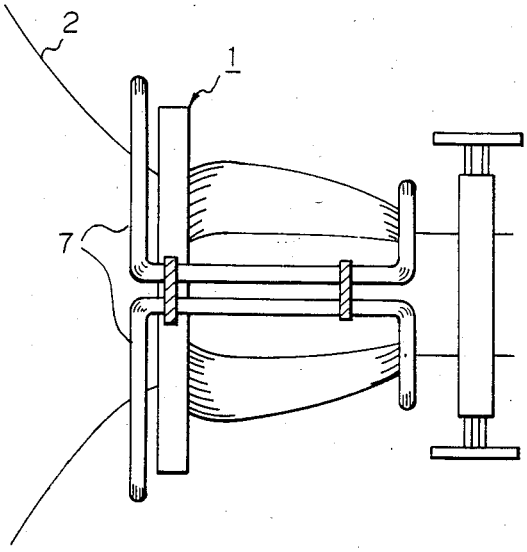
FIG. 3*a* is a side elevational view showing a radiation suppression device mounted onto a deflection yoke as an embodiment of the present invention.
Figure 3B:
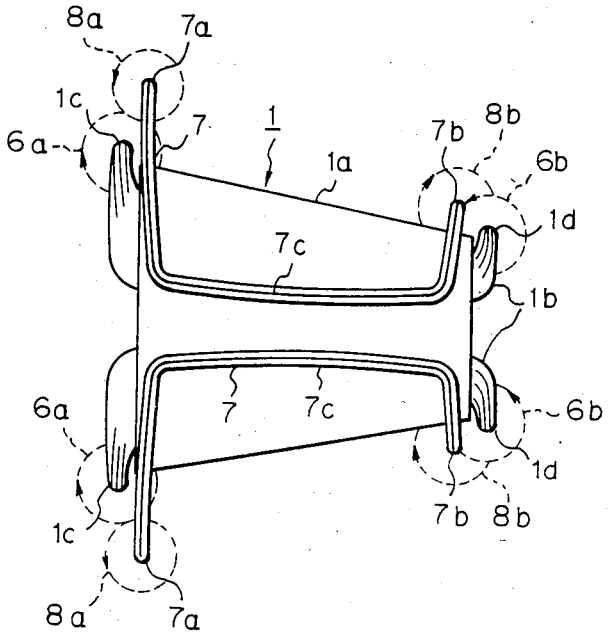
FIGS. 3*b* and 3*c* respectively show the distribution of magnetic lines of force at one side of and in a cross-sectional view of the deflection yoke shown in FIG. 3*a;*
Figure 3C:
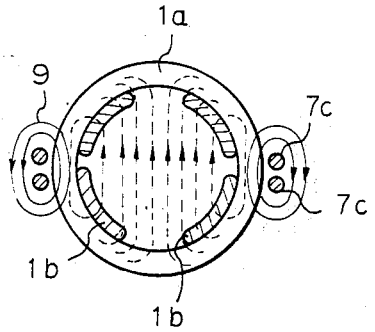
Figure 4A:
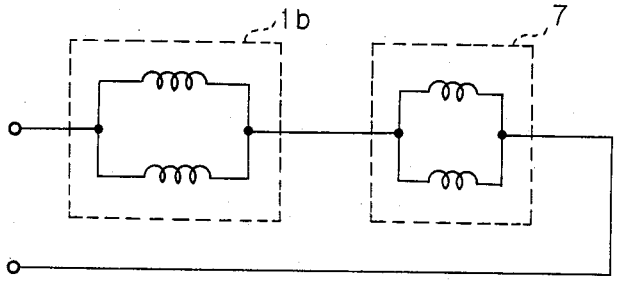
FIGS. 4*a,* 4*b* and 5 are, respectively, circuit diagrams showing examples of electrical connections between an auxiliary coil and a deflecting coil of the radiation suppression device shown in FIG. 3*a;*
Figure 4B:
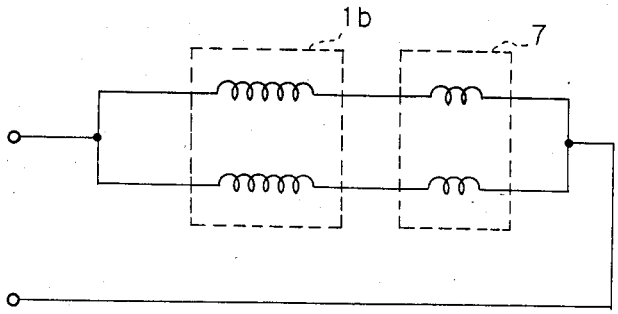
Figure 5:
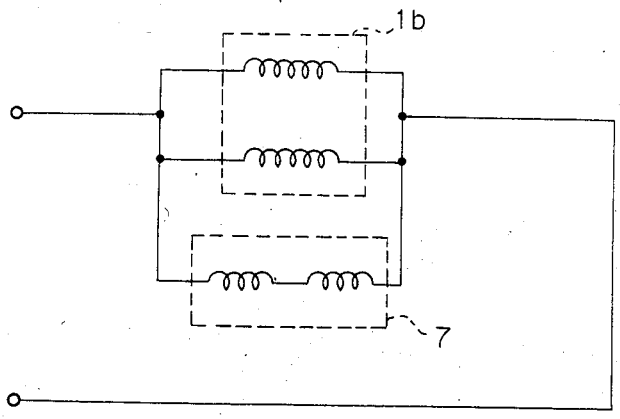

FIGS. 3*a* to 3*c,* FIG. 4 and FIG. 5 show one embodiment of the present invention.

In FIGS. 3*a* and 3*b,* an auxiliary coil 7 is mounted on the outer wall face of a core 1*a* such as to cover a horizontal deflecting coil 1*b* held within the core 1*a* of a deflection yoke 1 between coils 7 and 1*b.* The auxiliary coil 7 which has a number of turns equivalent to between 8% and 10% the number of turns of the horizontal deflecting coil 1*b* is wound in a saddle form closely similar to the horizontal deflecting coil 1*b,* and has coil sides 7*a* and 7*b* which are formed parallel to the crossover line portions 1*c* and 1*d* of the horizontal deflecting coil 1*b.* The coil side 7*c* disposed parallel to the axis line of the auxiliary coil 7 is fixed such as to extend in the axial direction along the outer face of the core 1*a.* The number of turns and the winding direction of the auxiliary coil 7 and the electrical connection with the horizontal deflecting coil 1*b* are in advance so selected that, when a horizontal deflecting current passes through the auxiliary coil 7 and the horizontal deflecting coil 1*b,* magnetic fields 8*a* and 8*b* shown by a dotted arrow in FIG. 3*b* are produced so as to cancel leak magnetic fields 6*a* and 6*b* produced from the crossover line portions 1*c* and 1*d* of the horizontal deflecting coil 1*b.*

FIGS. 4*a* and 4*b,* and FIG. 5 show examples of the electrical connection in such cases. The auxiliary coil 7 can be connected in series with the horizontal deflecting coil 1*b* (FIG. 4*a* and FIG. 4*b*). In this constitution, when the scanning current flows through the horizontal deflecting coil 1*b* and the auxiliary coil 7 connected in series therewith, the rectilinear portion within the core 1*a* in the horizontal deflecting coil 1*b* produces a definite direction of magnetic field in the space within the core as an effective field (deflection field), as shown in FIG. 3*c.* On the other hand, in the crossover portions outward of the core 1*a* shown in FIG. 3*b,* the leak magnetic fields 6*a* and 6*b* are irradiated outwardly. Conversely, since the auxiliary coil 7 is connected as shown in FIG. 4*a* or FIG. 4*b* and an upper half of coil 7 and a lower half coil 7 are, respectively, wound such as to form a counter magnetic field which is reverse in direction to that of the magnetic field of the corresponding deflecting coil 1*b,* the magnetic fields 8*a* and 8*b* are produced and act to cancel the above-described leak magnetic field. This being so, as the auxiliary coil 7 is mounted on the outside of the deflection yoke 1, the influence brought about by the auxiliary coil 7 can be inhibited by the core 1*a* with regard to the magnetic field in the space which is surrounded by the core 1*a* as shown in FIG. 3*c.* At the same time, as the number of turns of the auxiliary coil 7 is much smaller than those of the horizontal deflecting coil 1*b,* the effect created by the leak magnetic field 9 in the rectilinear portion is so small as to be ignored as an undesired signal level with respect to the outer space.

As the recent trend in the design of display monitors is to aim at higher resolution, the horizontal scanning frequency is likely to be high and thus the impedance of the horizontal deflecting coil is reduced. For this reason, it is preferred to connect the auxiliary coil 7 in parallel with the horizontal deflecting coil 1*b* as shown in FIG. 5.

Figure 6:
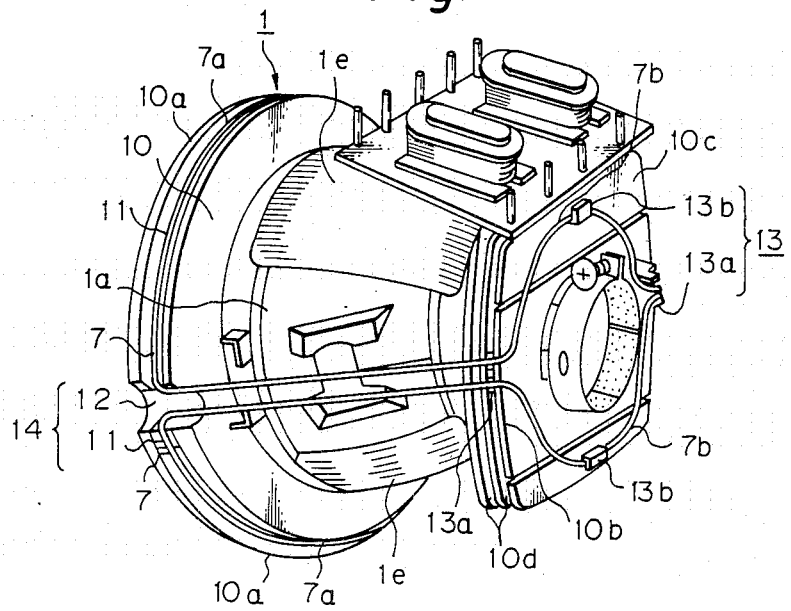
FIG. 6 is a perspective view showing an auxiliary coil of the radiation suppression device which can be easily mounted, as another embodiment of the present invention.

FIG. 6 shows another embodiment of the present invention which enables an auxiliary coil of the radiation suppression device in accordance with the present invention to be mounted easily. In the figure, 1*e* denotes a vertical deflecting coil and 10 a separator. On the outer circumferential surface 10*a* of the front portion of the separator covering the front crossover line portion 1*c* of the horizontal deflecting coil 1*b* in FIG. 3*b* is formed a groove 11, and at the two opposite points on the outer circumferential surface 1*a* depressed portions 12 are formed. The above-described groove 11 and depressed portions 12 constitute a first wire hanger portion 14 which is wound around the coil side 7*a* of the front side of the auxiliary coil 7. On both sides of the outer circumferential surface 10*b* of the rear portion of the separator 10 are formed hooks 13*a* while hooks 13*b* are respectively formed in the upper and lower portions of the back face 10*c* of the rear portion. The above-described hooks 13*a* and 13*b* form a second wire hanger portion 13 around which the coil side 7*b* of the auxiliary coil 7 is wound.

The auxiliary coil 7 is wound and formed simply by a predetermined number of turns of the wires around and through the hooks 13*b* and 13*a*, the corner between the depressed portion 12 and the groove 11, the groove 11, the depressed portion at the opposite side, the hook at the opposite side and the original hook 13*b* in that order.

When the wire is wound in this way using the wire hanger portions 13 and 14 formed on the outer surface and faces of the front and rear portions of the separator 10, the winding work can be done simply, the position of the auxiliary coil 7 is correct, and the wire so wound is held reliably by the wire hanger portions 13 and 14 without causing difficulties such as deformation or the like. In comparison with a case where the auxiliary coil 7 is prefabricated and mounted in that state, the winding work in accordance with the present invention is simple and easy and auxiliary coils 7 having consistent quality in their ability to cancel the undesired magnetic field can be formed into marketable products.

Figure 7:
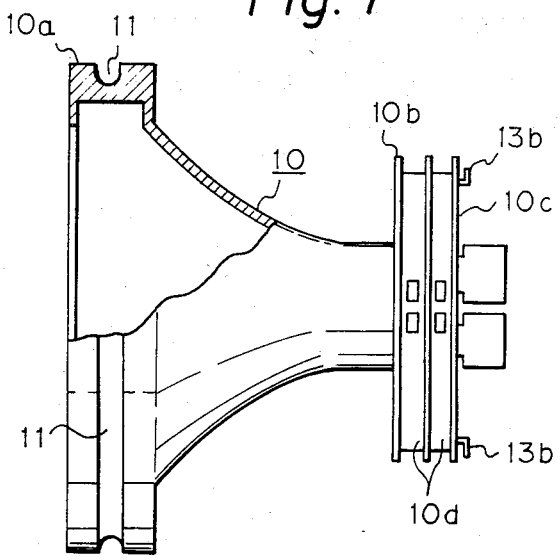
FIG. 7 is a partly fragmentary side view showing a separator for use in an embodiment as shown in FIG. 6.
Figure 8:
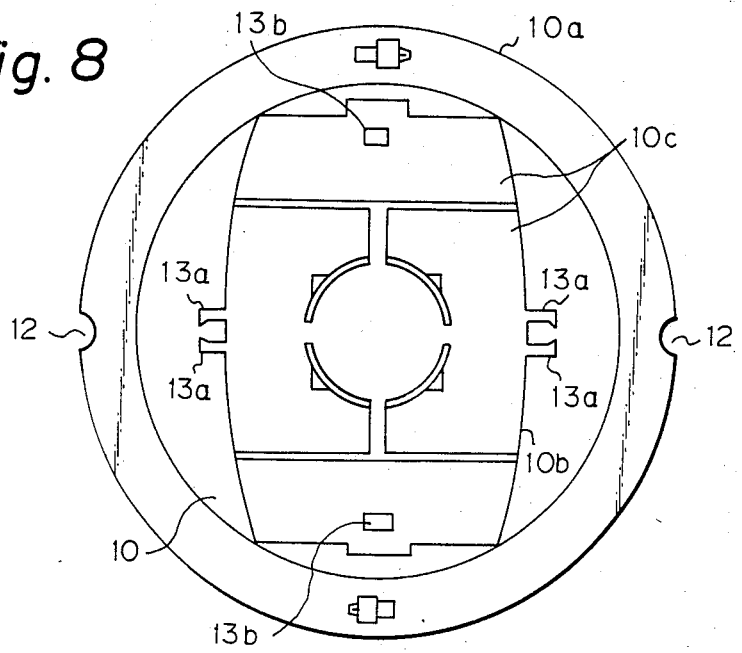
FIG. 8 is a rear elevational view showing a separator for use in an embodiment as shown in FIG. 6.

FIG. 7 is a side view showing a partly exploded separator 10 employed in the above-described embodiment, and FIG. 8 is a rear elevation viewing the separator 10 from the rear.

In the embodiment shown in FIGS. 6 to 8, the wire hanger portions 13 and 14 are formed by the groove 11, depressed portions 12 and hooks 13*a* and 13*b*. Also, pins for preventing the wire from falling off may be employed in place of the groove 11, while grooves 10*d* may be formed on the outer circumferential surface 10*b* of the rear portion of the separator 10 in place of the hooks 13*a* and 13*b*.

Figure 9:
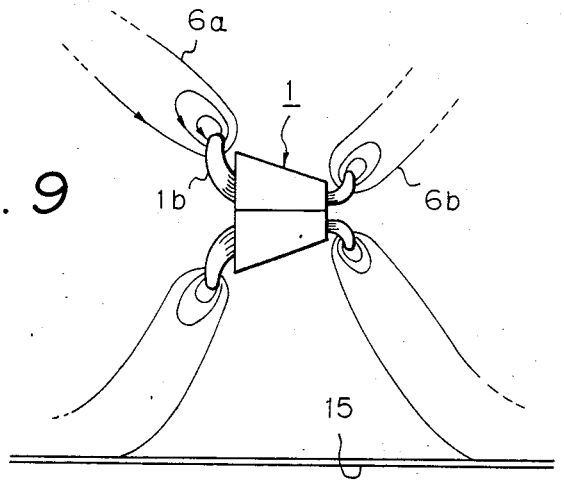
FIG. 9 is an explanatory diagram illustrating the fact that when a metal plate exists around the deflection yoke, undesired radiation produced form a deflecting coil is nonsymmetrical.

As mentioned above, the present invention allows the undesired magnetic field which is irradiated outwardly when the scanning current flows through the deflecting coil 1*b* to be cancelled by the magnetic field produced by the auxiliary coil 7 which has a form as similar to the deflecting coil as possible. As a deflection yoke including the radiation suppression device of the present invention is, in fact, put into a housing, when the deflection yoke is surrounded at some distance from its circumference by a metal sheet 15 (FIG. 9), the undesired magnetic field 6 produced by the deflecting coil is reflected under the influence of the metal sheet 15, and the distribution of the magnetic field becomes asymmetrical both in the vertical direction and in the horizontal direction. On the other hand, since the magnetic field produced by the auxiliary coil 7 is symmetrical, the action by which the auxiliary coil cancels is adversely affected in such a case. Increasing the number of turns of the auxiliary coil works well to prevent such adverse factor, but such a solution exerts a harmful influence upon the effective magnetic field of the deflecting coil.

Figure 10:
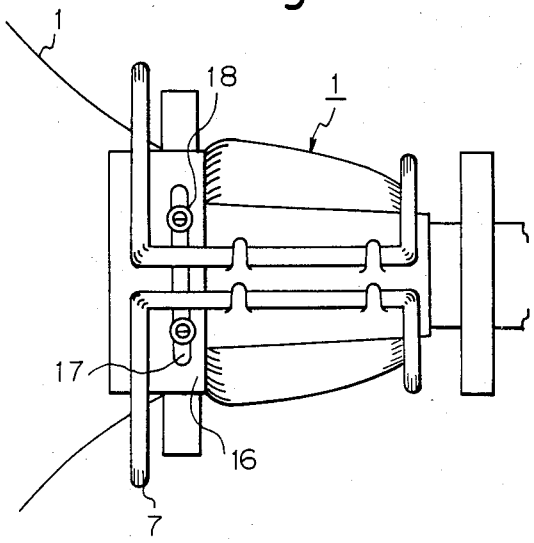
FIG. 10 is a schematic side view showing a still further embodiment of the radiation suppression device in accordance with the present invention, in which the position of an auxiliary coil is adjustable.
Figure 11:
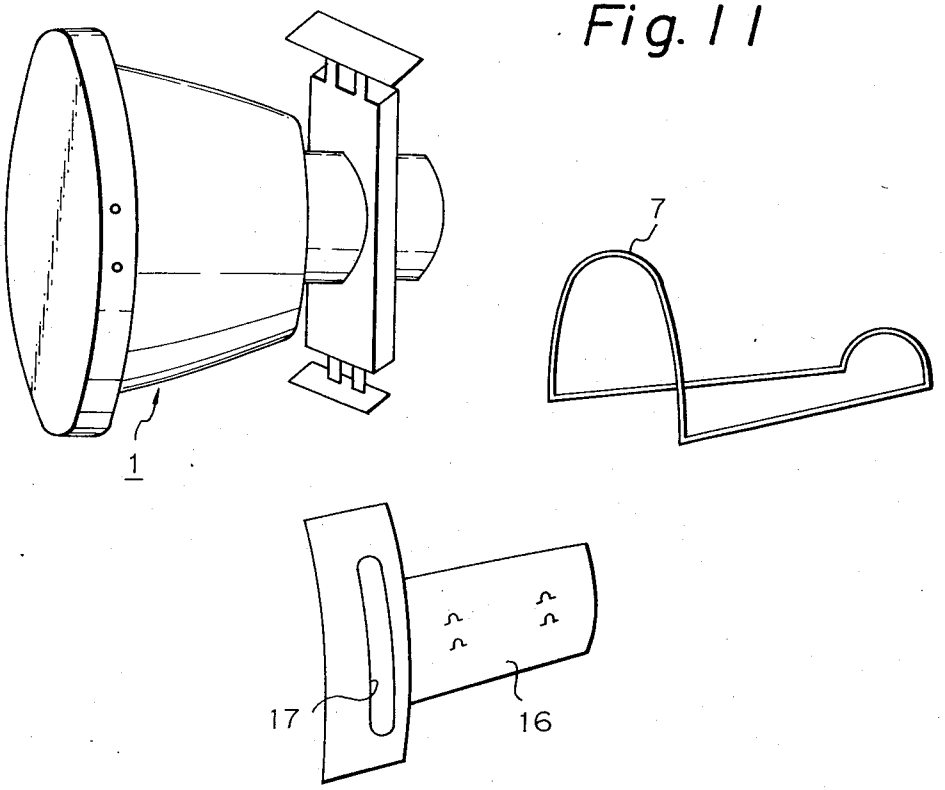
FIG. 11 shows each principal component of the embodiment shown in FIG. 10.

FIGS. 10 and 11 show a still further embodiment of the present invention which enables the undesired magnetic field to be cancelled effectively by means of the auxiliary coil even when the undesired magnetic field irradiated from the deflecting coil is asymmetrical. In both figures, the numeral 16 denotes a fixture for installing the deflection yoke 1 together with the auxiliary coil 7, and an elongated slit 17 is formed in this fixture 16. In accordance with specific usage, the fixture 16 is rotated in the clockwise direction or in the counter-clockwise direction with respect to the central axis of a cathode ray tube 1 and is fixed by screws 18 at the position where the cancelling effect with respect to the undesired magnetic field is the highest.

Figure 1C:
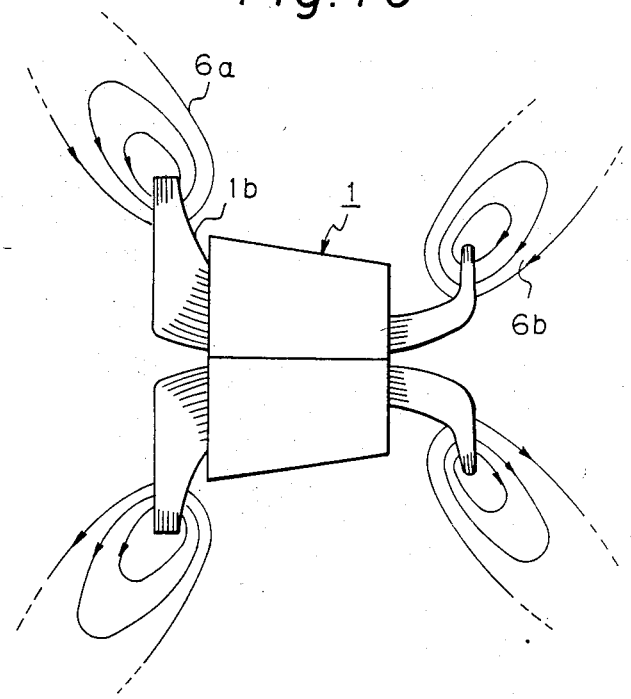

In such a structure, the intensity of the magnetic field produced by the auxiliary coil 7 is not affected so much by the environment, since the number of turns of the auxiliary coil 7 is extraordinarily small in comparison with that of the deflecting coil. Accordingly, the distribution of the magnetic field in the auxiliary coil is similar to that of the undesired magnetic field shown in FIG. 1*c*. With regard to the asymmetrical undesired magnetic field shown in FIG. 9, when the auxiliary coil 7 is rotated in the clockwise direction or in the counter-clockwise direction around the central axis of the cathode ray tube 1, the magnetic field produced form the auxiliary coil is also rotated and becomes asymmetrical compared to what is shown in FIG. 3*a*. Accordingly, it is possible to attain the position at which the cancelling effect with respect to the undesired radiation is maximum. The range of adjustment in this case is about $\pm 10°$ of the rotational angle. The elongated slit 17 of the fixture 16 is arranged in advance so that the position of the auxiliary coil 7 itself may be finely adjusted to-and-fro.

Figure 2:
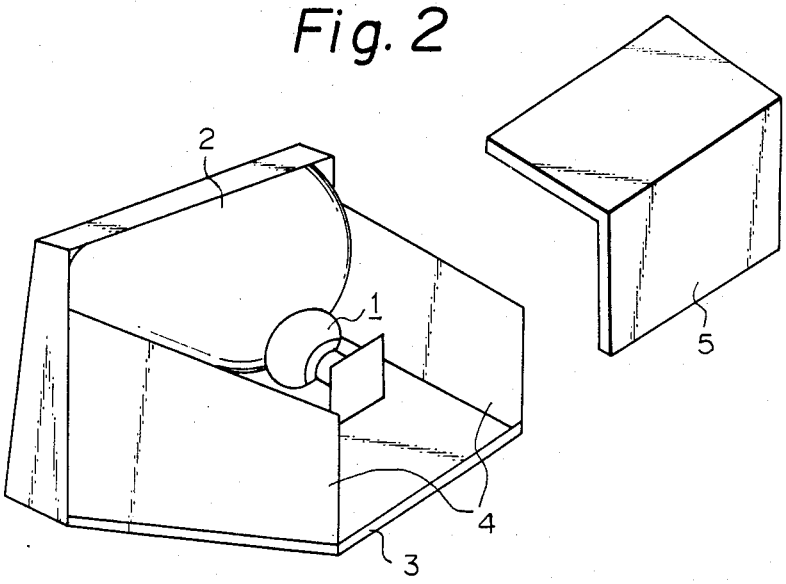
FIG. 2 is a partly cut-away perspective diagram of the prior art cathode ray tube display unit having radiation suppression device.
Figure 12:
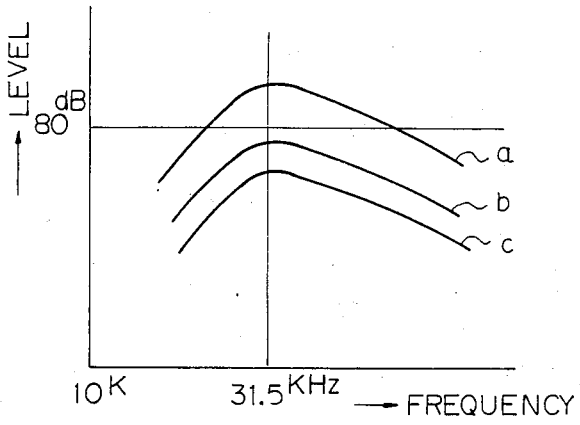
FIG. 12 is a graph showing the cancelling effect with respect to undesired radiation achieved by the radiation suppression device according to the present invention in comparison with the prior art example.

FIG. 12 demonstrates the cancelling effect with respect to the undesired radiation based upon the radiation suppression device in accordance with the present invention; the level of undesired radiation is denoted in each case in curve (a) when means for suppressing the undesired radiation from the deflecting coil is not installed; in curve (b) when the magnetic shielding shown in FIG. 2 is implemented; and in curve (c) when the radiation suppression device of the present invention is installed. This graph demonstrates that at the frequency of 31.5 KHz, the level of undesired radiation is reduced by 10 dB in the case of curve (b) and by 15 dB in the case of curve (c), as compared with the case of curve (a).

While the preferred form of the present invention has been described, it is to be understood that modification will be apparent to those skilled in the art without departing from the spirit of the invention.

The scope of the invention, therefore, is to be determined solely by the following claims.

What is claimed is:

1. A radiation suppression device for suppressing undesired radiation due to a leak magnetic field produced by a deflecting coil that is wound around a deflection yoke of a cathode ray tube display unit, said device comprising:

an auxiliary coil connected electrically with said deflecting coil and wound around the outer wall face of said deflection yoke at a position corresponding to the position at which said deflecting coil is wound;

wherein the number of turns and the direction of winding of said auxiliary coil are so selected that the leak magnetic field produced by said deflecting coil is cancelled by the magnetic field produced by said auxiliary coil.

2. A device according to claim 1, wherein said deflecting coil is a horizontal deflecting coil.

3. A device according to claim 2, wherein said auxiliary coil is connected in series with said horizontal deflecting coil.

4. A device according to claim 2, wherein said auxiliary coil is connected in parallel with said horizontal deflecting coil.

5. A device according to any one of claims 1–4, wherein said auxiliary coil is wound such as to form a saddle shape.

6. A radiation suppression device for suppressing undesired radiation due to a leak magnetic field produced by a deflecting coil that is wound around a deflection yoke of a cathod ray tube display unit, said device comprising:

an auxiliary coil connected electrically with said deflecting coil and wound around the outer wall face of said deflection yoke at a position corresponding to the position at which said deflecting coil is wound so as to cancel said leak magnetic field;

characterized in that said auxiliary coil is formed by hanging wires over a plurality of hanger means which are formed with a predetermined form at predetermined positions on the outer faces of a separator which constitutes said deflection yoke.

7. A device according to claim 6, wherein said deflecting coil is a horizontal deflecting coil.

8. A device according to claim 7, wherein said hanger means comprises a groove formed on the outer circumferential surface of the front crossover line portions of said horizontal deflecting coil and depressed portions that are formed at two opposite points on said outer circumferential surface.

9. A device according to claim 7, wherein said hanger means comprises a plurality of deflection preventing pins formed on the outer circumferential surface of the front portion of said separator which covers the front crossover line portions of said horizontal deflecting coil.

10. A device according to claim 8 or claim 9, wherein said hanger means further comprises a plurality of hooks formed on the outer circumferential surface and the back face of the rear portion of said separator covering the rear crossover line portions of said horizontal deflecting coil.

11. A device according to claim 8 or claim 9, wherein said hanger means further comprises grooves formed on the outer circumferential surface of the rear portion of said separator covering the rear crossover line portions of said horizontal deflecting coil.

12. A radiation suppression device for suppressing undesired radiation due to a leak magnetic field produced form a deflecting coil that is wound around a deflection yoke of a cathode ray tube display unit, said device comprising:

an auxiliary coil connected electrically with said deflecting coil and wound around the outer wall face of said deflection yoke at a position corresponding to the position at which said deflecting coil is wound so as to cancel said leak magnetic field;

characterized in that said auxiliary coil is mounted on a holding means that is held movably on the outer wall face of said deflection yoke.

13. A device according to claim 12, wherein said holding means is rotatable around the central axis of said deflection yoke.

14. A device according to claim 13, wherein said holding means is further movable in the longitudinal direction of said deflection yoke.

* * * * *